United States Patent [19]

Takao et al.

[11] Patent Number: 4,522,176

[45] Date of Patent: Jun. 11, 1985

[54] AIR FLOW CONTROL APPARATUS FOR INTERNAL COMBUSTION ENGINE

[75] Inventors: Mitsunori Takao, Kariya; Takahiko Kimura, Nagoya; Yuji Hirabayashi, Chita, all of Japan

[73] Assignee: Nippondenso Co., Ltd., Kariya, Japan

[21] Appl. No.: 636,602

[22] Filed: Aug. 1, 1984

[30] Foreign Application Priority Data

Aug. 4, 1983 [JP] Japan ..... 58-142735

[51] Int. Cl.[3] ..... F02D 33/02

[52] U.S. Cl. ..... 123/339; 123/585; 123/588

[58] Field of Search ..... 123/339, 588, 585, 340

[56] References Cited

U.S. PATENT DOCUMENTS 3,964,457 6/1976 Coscia ..... 123/339
4,344,399 8/1982 Matsumura et al. ..... 123/339
4,475,504 10/1984 Mizuno ..... 123/339

FOREIGN PATENT DOCUMENTS 55-156230 12/1980 Japan .

*Primary Examiner*—Andrew M. Dolinar
*Attorney, Agent, or Firm*—Cushman, Darby & Cushman

[57] ABSTRACT

In an air flow control apparatus for controlling an amount of air flow under control of a throttle valve in an engine, a sensor produces a first signal indicative of engine operation, and another sensor produces a second signal indicative of the atmospheric pressure. A microcomputer determines whether or not the first signal indicates an idling condition of the engine. If so, the microcomputer calculates, in dependence upon the first signal, a first parameter indicative of an amount of the air flow necessary for maintaining a desired idling condition of the engine. If not, the microcomputer calculates, in dependence upon the first signal, a second parameter indicative of an amount of the air flow related to loaded condition of the engine. Furthermore, the microcomputer calculates, in dependence upon the second signal, a third parameter indicative of an additional amount of the air flow related to the atmospheric pressure to compensate the second parameter and produces first and second output signals respectively indicative of the first and compensated second parameters. An electrically operated valve is responsive to the first and second output signals for controlling an amount of the air flow respectively related to idling and loaded conditions of the engine.

5 Claims, 6 Drawing Figures

AIR FLOW CONTROL APPARATUS FOR INTERNAL COMBUSTION ENGINE

BACKGROUND OF THE INVENTION

The present invention relates to a control system for an internal combustion engine, and more particularly to an air flow control apparatus for controlling an amount of air flow under control of a throttle valve into the engine.

In such a conventional air flow control apparatus as disclosed, for example, in a Japanese Patent Early Publication No.55-156230, an amount of the air flow in loaded condition of the engine is adjusted in open-loop control in dependence upon temperature of cooling water of a cooling system for the engine. When the engine is conditioned in idling operation, operation of the apparatus is switched from the open-loop control to feedback control such that an amount of the air flow is adjusted in accordance with the actual idling speed of the engine to bring the actual and desired idling speeds in accord. In this instance, an initial value of an amount of the air flow at the switchover timing from the open-loop control to the feedback control is determined based on an amount of the air flow in open-loop control, taking account of temperature of the cooling water and the loaded condition of the engine, to ensure smooth idling speed of the engine.

However, in such an air flow control apparatus, it is recognized that an amount of the air flow into the engine is generally adjusted based on density of air corresponding to a standard atmospheric pressure of 760 mmHg at a low place where an automotive vehicle travels. This means that an amount of the adjusted air flow at a high place, where the vehicle travels, will substantially decrease in comparison with that at the low place, because density of air decreases due to lowering of the atmospheric pressure caused by rise in height of the vehicle travel place. As a result, it is observed that when operation of the control apparatus is switched from the open-loop control to the feedback control after travelling of the vehicle under the open-loop control at a stretch from the low place to the high place, the above-mentioned substantial decrease in density of air induces undesired lowering of idling speed or stop of the engine, as understood from FIG. 1.

SUMMARY OF THE INVENTION

It is, therefore, a primary object of the present invention to provide an air flow control apparatus for an internal combustion engine capable of increasing an amount of air flow into the engine in dependence upon rise in height of a travel place of an automotive vehicle.

According to the present invention there is provided an air flow control apparatus for controlling an amount of air flow under control of a throttle valve in an internal combustion engine, the control apparatus which comprises:

first means for producing a first signal indicative of operating condition of the engine;

second means for detecting change of the atmospheric pressure and for producing a second signal indicative of the actual atmospheric pressure;

third means for determining whether or not a value of the first signal indicates an idling condition of the engine if so, producing a first determination signal and if not, producing a second determination signal;

fourth means responsive to the first determination signal for determining, in dependence upon the value of the first signal, a first parameter indicative of an amount of air flow into the engine necessary for maintaining the operation of the engine in a desired idling condition;

fifth means responsive to the second determination signal for determining, in dependence upon the value of the first signal, a second parameter indicative of an amount of air flow into the engine based on a first predetermined relationship between the second parameter and loaded condition of the engine;

sixth means for determining, in dependence upon a value of the second signal, a third parameter indicative of an additional amount of air flow into the engine based on a second predetermined relationship between the third parameter and the atmospheric pressure;

seventh means for compensating the second parameter in accordance with the third parameter;

eighth means for producing a first output signal indicative of the first parameter and for producing a second output signal indicative of the compensated second parameter; and ninth means responsive to the first and second output signals for controlling an amount of air flow respectively in accordance with idling and loaded conditions of the engine.

BRIEF DESCRIPTION OF THE DRAWINGS

Additional objects and advantages of the present invention will be more readily apparent from the following detailed description of a preferred embodiment thereof when taken together with the accompanying drawings in which.

DESCRIPTION OF THE PREFERRED EMBODIMENT

Figure 1:
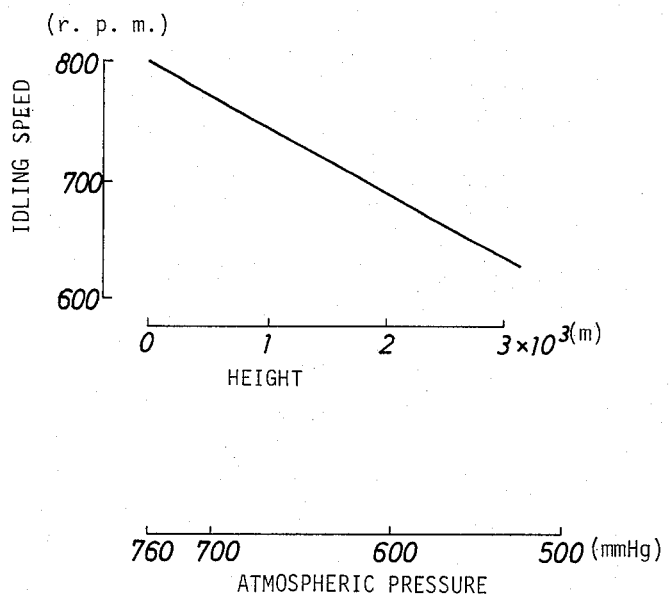
FIG. 1 depicts a graph indicating idling speed of an internal combustion engine of an automotive vehicle related to the atmospheric pressure or height.
Figure 2:
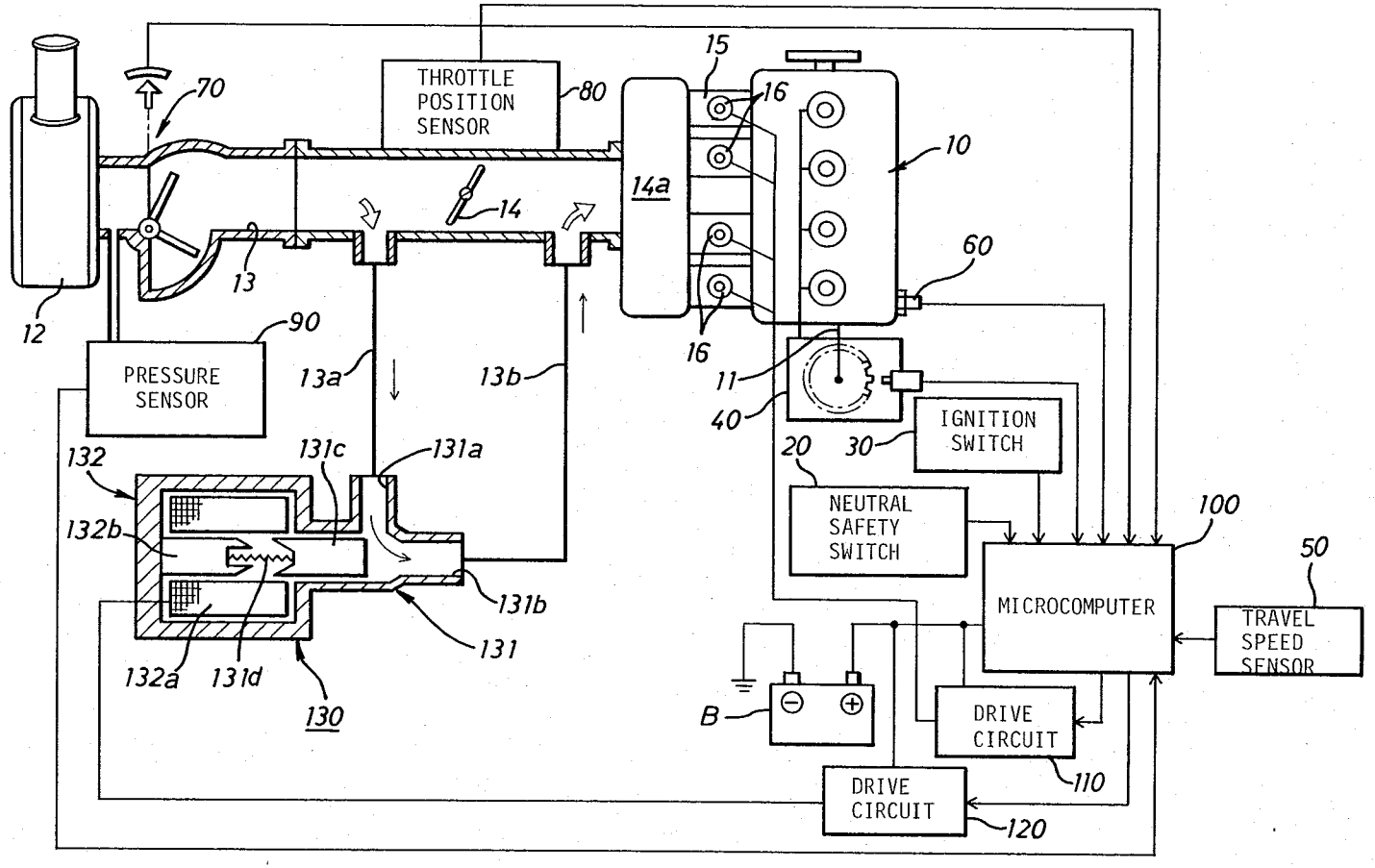
FIG. 2 is a block diagram of an elecronic fuel injection control system for the engine.

Reffering now to FIG. 2 of the drawings, there is illustrated a preferred embodiment of the present invention adapted to an electronic fuel injection control system for a four cylinder internal combustion engine 10 of an automotive vehicle. The fuel injection control system includes a microcomputer 100 which is connected to switches 20, 30, various sensors 40 to 90 and a DC source B of electricity for the vehicle. The neutral safety switch 20 is closed upon shift of an automatic transmission of the vehicle to the neutral position to produce a neutral signal. The iginition switch 30 is provided with a movable contact and with a starter terminal which is selectively connected by the movable contact to produce a starter signal.

The rotational speed sensor 40 detects the actual rotational speed of a crankshaft 11 of engine 10 to produce a series of pulse signals respectively with a frequency proportional to the detected rotational speed. The travel speed sensor 50 detects the actual travel speed of the vehicle to produce a series of pulse signals respectively with a frequency proportional to the detected travel speed. The water temperature sensor 60 detects the actual temperature of cooling water in a cooling system of engine 10 to produce a water temperature signal indicative of the detected cooling water temperature. The air flow sensor 70 detects the actual amount of air sucked or flowing into an induction passage 13 of engine 10 from an air cleaner 12 and produces an air flow signal indicative of the detected amount of the air flow.

The throttle position sensor 80 detects a closed position of a throttle valve 14 provided in the induction passage 13 and produces a throttle position signal indicative of the detected closed throttle position. The pressure sensor 90 detects the actual pressure of the air flow at upstream of throttle valve 14 in the induction passage 13 to produce a pressure signal indicative of the detected pressure of the air flow. The microcomputer 100 previously memorizes therein a computer program which is defined by flow diagrams shown in FIGS. 3 and 4. Under cooperation with the switches 20, 30 and sensors 40 to 90, the microcomputer 100 repetitively performs the memorized computer program in accordance with the flow diagrams to control a drive circuit 110 connected to fuel injectors 16—16 of engine 10 and also to control a drive circuit 120 connected to an electromagnetic flow control mechanism 130, as described later.

The flow control mechanism 130 is provided with a flow control valve 131 and also with a linear actuator 132 assembled to the flow control valve 131. The flow control valve 131 has inlet and outlet ports 131*a*, 131*b* which are connected to bypass passages 13*a*, 13*b* respectively. These bypass passages 13*a*, 13*b* extend respectively from upstream and downstream of the throttle valve 14 in the induction passage 13. The flow control valve 131 also has a valve body 131*c* of the rod type which controls a communication degree between the inlet and outlet ports 131*a*, 131*b* or an opening degree of flow control valve 131. The linear actuator 132 includes a solenoid 132*a* which intermittently receives a DC current from the source B of electricity under control of drive circuit 120, as described later, to generate an electromagnetic force corresponding to an average value of the intermittent DC current. This means that the valve body 131*c* is displaced by the electromagnetic force of solenoid 132*a* against a resilient force of a compression spring 131*d* to increase the opening degree of flow control valve 131. In this case, the opening degree of flow control valve 131 is proportional to an amount in displacement of the valve body 131*c* or the electromagnetic force of solenoid 132*a*. Additionally, the compression spring 131*d* is assembled between a stationary rod 132*b* of actuator 132 and the valve body 131*c* to bias the valve body 131*c* toward the outlet port 131*b*.

OPERATION

Figure 3:
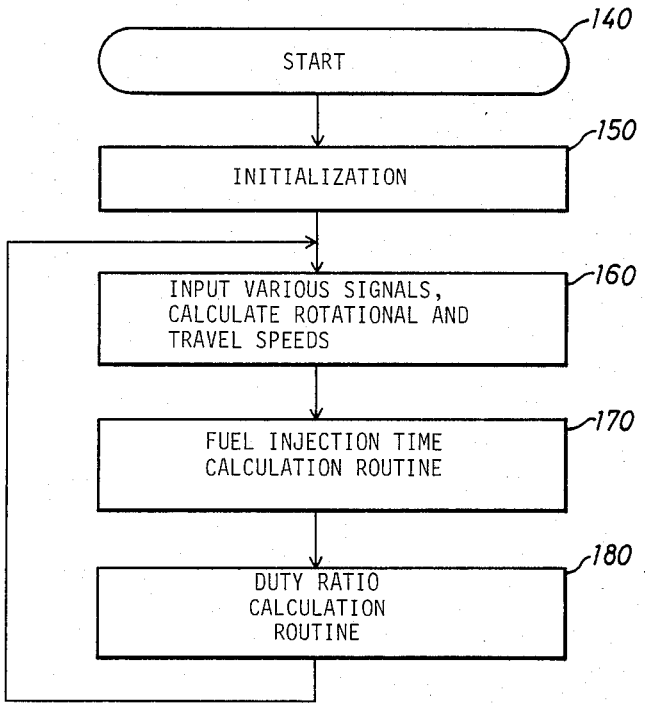
FIG. 3 is a flow diagram illustrating operation of the microcomputer shown in FIG. 2.

When the ignition switch 30 is closed to start the engine during arrest of the vehicle at a low place with the automatic transmission shifted to the neutral position, a starter signal is produced from the ignition switch 30, a neutral signal is produced from the neutral safety switch 20, and the microcomputer 100 starts to perform the computer program at a step 140 in accordance with the flow diagram of FIG. 3. Upon completing initialization at the following step 150, the microcomputer 100 temporarily memorizes the neutral and starter signals respectively from the switches 20, 30 at a step 160 and then calculates the actual rotational speed of engine 10 on a basis of pulse signals from rotational speed sensor 40 to temporarily memorize the calculated actual rotational speed of engine 10. Subsequently, the microcomputer 100 converts values of the water temperature and air flow signals respectively from the sensors 60, 70 into water temperature and air flow digital values to temporarily memorize the same digital values. In case the throttle valve 14 is closed at this stage, the microcomputer 100 further memorizes a throttle position signal indicative of the closed throttle position from throttle position sensor 80. In addition, the actual travel speed of the vehicle calculated by the microcomputer 100 under cooperation with the travel speed sensor 50 is zero, because of the arrest of the vehicle.

Figure 4:
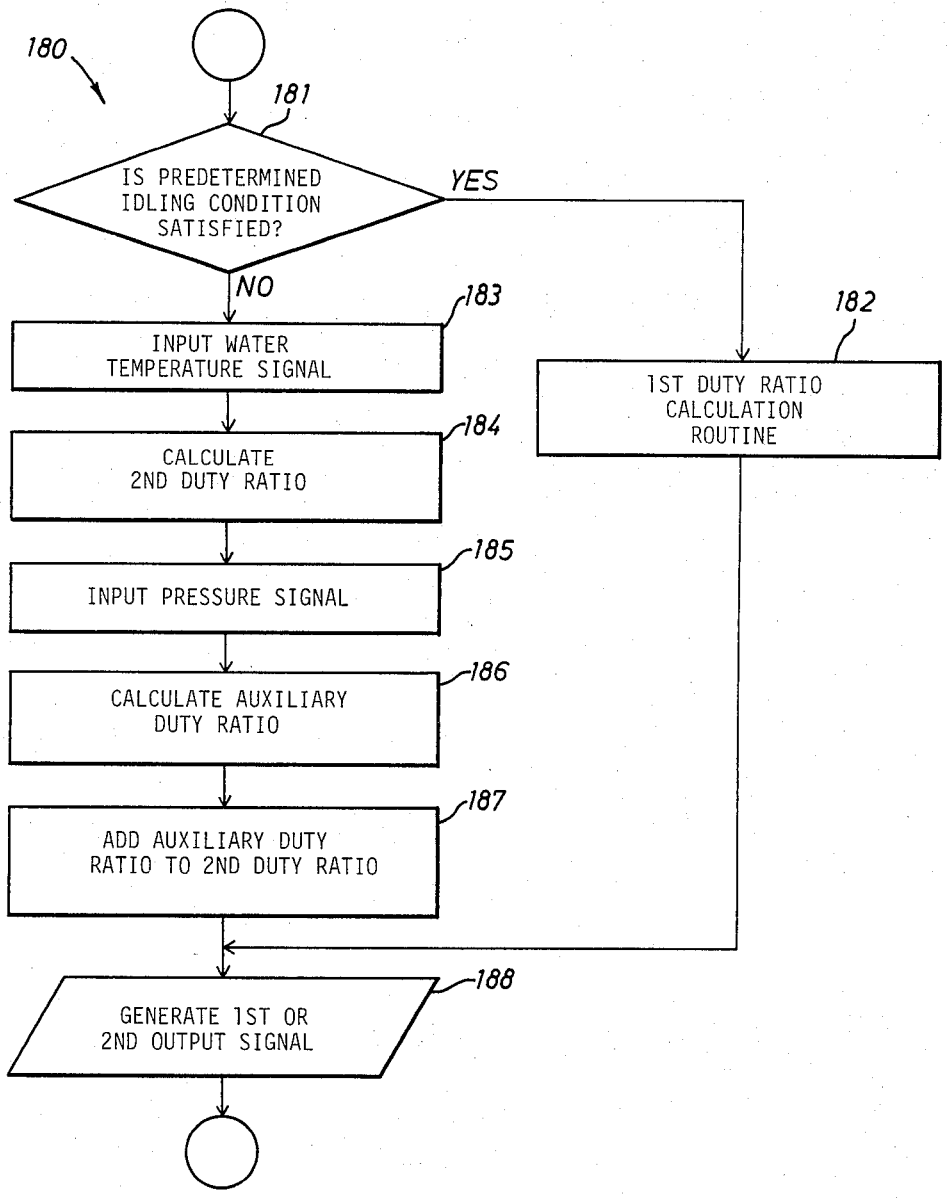
FIG. 4 is a detailed flow diagram illustrating the duty ratio calculation routine shown in FIG. 3.

When the computer program proceeds to a duty ratio calculation routine 180 shown by the flow diagrams of FIGS. 3, 4, the microcomputer 100 determines an "YES" answer at a step 181 if a predetermined condition indicative of idling of engine 10 is satisfied at this stage. In the embodiment, the predetermined condition indicative of idling of engine 10 is defined by the fact that a throttle position signal indicative of the closed throttle position appears from throttle position sensor 80, that the actual rotational speed of engine 10 memorized in microcomputer 100 is lower than or equal to 1000 r.p.m. and that the actual travel speed of the vehicle memorized in microcomputer 100 is lower than or equal to 2 km/h.

When the decision at step 181 is "YES", as previously described, the microcomputer 100 advances the computer program to a first duty ratio calculation routine 182 where a first duty ratio indicative of an amount of air flow into the engine 10 is calculated from a predetermined relationship among the first duty ratio, a desired idling speed of engine 10 and the actual idling speed of engine 10 in dependence upon the actual rotational speed calculated at step 160 and is compensated in dependence upon the neutral and starter signals memorized at step 160. This means that the microcomputer 100 produces a first output signal indicative of the compensated first duty ratio at the following step 188. In the embodiment, the amount of air flow indicated by the first duty ratio defines an amount of fuel to be supplied to engine 10 under idling operation from the source of fuel in order to reduce a difference between the desired and actual idling speeds of engine 10.

When the first output signal appears from the microcomputer 100, as previously described, the drive circuit 120 applies a DC current from the source B of electricity to the solenoid 132*a* of flow control mechanism 130 intermittently at the compensated first duty ratio defined by the first output signal. Then, the solenoid 132*a* generates an electromagnetic force based on an average value of the intermittent DC current from drive circuit 120, and the valve body 131*c* is attracted by the electromagnetic force of solenoid 132*a* against the resilient force of compression spring 131*d* to open the flow control valve 131. This means that an opening degree of flow control valve 131 is proportional to an amount in displacement of valve body 131*c* caused by the electromagnetic force of solenoid 132*a* related to the compensated first duty ratio described above. Thus, an air flow into the induction passage 13 from the air cleaner 12 is sucked through the bypass passage 13*a*, inlet and outlet ports 131*a*, 131*b* of flow control valve 131, bypass passage 13*b*, a surge tank 14*a* and an intake manifold 15 into each cylinder of engine 10 at an amount defined by the opening degree of flow control valve 131.

After returning the computer program to step 160, the microcomputer 100 advances the computer program to a fuel injection time calculation routine 170 where a fundamental injection time corresponding to a fundamental amount of fuel injected into the engine 10 is calculated from a predetemined relationship amoung the fundamental injection time, the actual rotational speed of engine 10 and the digital amount of air flow in accordance with the actual rotational speed and digital amount of air flow memorized at step 160. Then, the microcomputer 100 compensates the calculated fundamental injection time in accordance with the digital temperature of cooling water and the like to set the compensated injection time into a down counter of the microcomputer 100 as an optimum injection time.

Then, the down counter of microcomputer 100 starts to count the optimum injection time down to zero and simultaneously produces an injection signal upon receipt of which the drive circuit 110 applies the DC current from the source B of electricity to the fuel injectors 16—16. Thus, the fuel injectors 16—16 are opened and start to inject fuel from the source of fuel into the engine 10. When the injection signal disappears upon completing the count down of the down counter of microcomputer 100, the fuel injectors 16—16 close under cooperation with the drive circuit 110 to stop the fuel injection into engine 10. This means that the actual idling speed of engine 10 is controlled toward the desired idling speed based on an air-fuel ratio defined by the amount of air flow corresponding to the compensated first duty ratio and the above-mentioned amount of fuel injected into engine 10.

Figure 5:
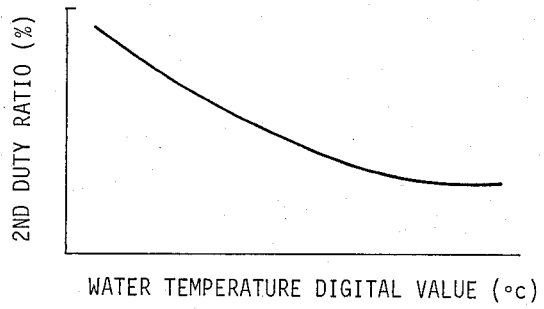
FIG. 5 depicts a graph illustrating a second duty ratio related to a water temperature digital value.

When the decision at step 181 of FIG. 4 becomes "no" upon start of the vehicle, the microcomputer 100 converts at a step 183 a value of the temperature water signal from sensor 60 into a water temperature digital value to temporarily memorize the same digital value. Then, the microcomputer 100 advances the computer program to a step 184 at which a second duty ratio indicative of an amount of air flow into engine 10 is calculated from a characteristic curve (see FIG. 5) indicating a predetermined relationship between the second duty ratio and the water temperature digital value in accordance with the water temperature digital value memorized at step 183. In the embodiment, the amount of air flow indicated by the second duty ratio defines an amount of fuel to be supplied into engine 10 from the source of fuel under loading operation of engine 10. Furthermore, the above-mentioned characteristic curve is experimentally obtained and previously memorized in the microcomputer 100.

When the computer program proceeds to a step 185, the microcomputer 100 converts a value of a pressure signal from sensor 90 into a pressure digital value to temporarily memorize the same digital value. At this stage, the pressure digital value is 760 mmHg, because the vehicle travels on the low place. Then, the microcomputer 100 advances the computer program to the following step 186 at which an auxiliary duty ratio indicative of an additional air flow into engine 10 is calculated from a characteristic linear line (see FIG. 6) indicating a predetermined relationship between the auxiliary duty ratio and the pressure digital value in accordance with the pressure digital value memorized at step 185. In this instance, the calculated auxiliary duty ratio is zero, because the memorized pressure digital value is 760 mmHg, as previously described. Thereafter, the microcomputer 100 adds the auxiliary duty ratio or zero calculated at step 186 to the second duty ratio calculated at step 184 and produces at a step 188 a second output signal indicative of the added resultant duty ratio. In the embodiment, the characteristic linear line is experimentally obtained and previously memorized in microcomputer 100.

When the second output signal appears from the microcomputer 100, as previously described, the drive circuit 120 applies the DC current from the source B of electricity to the solenoid 132*a* of flow control mechanism 130 intermittently at the added resultant duty ratio defined by the second output signal. Thus, the solenoid 132*a* generates an electromagnetic force based on an average value of the intermittent DC current from drive circuit 120, and the flow control valve 131 is controlled in its opening degree in proportion to the electromagnetic force of solenoid 132*a*. As a result, an air flow into the induction passage 13 from the air cleaner 12 is partly sucked through the throttle valve 14 into each cylinder of engine 10, and the remainder of the air flow is sucked through the bypass passage 13*a*, flow control valve 131, bypass passage 13*b*, surge tange 14*a* and intake manifold 15 into each cylinder of engine 10 at an amount defined by the opening degree of flow control valve 131.

When the computer program proceeds to the fuel injection time calculation routine 170, the microcomputer 100 calculates a fundamental injection time in accordance with the actual rotational speed of engine 10 and digital amount of air flow memorized newly at step 160, as previously described. When the calculated fundamental injection time is compensated into an optimum injection time, as previously described, the microcomputer 100 sets the optimum injection time into the down counter thereof under control of which the drive circuit 110 cooperates with the source B of electricity to open the fuel injectors 16—16. This means that the fuel injectors 16—16 inject fuel from the source of fuel into each cylinder of engine 10 during the above-mentioned optimum injection time. Since at this stage density of air is maintained a value corresponding to 760 mmHg in the travel place of the vehicle, an air-fuel ratio is properly determined based on the amount of fuel injected into engine 10 and the amount of air flow defined by the added resultant duty ratio (or the calculated second duty ratio) and the actual opening degree of the throttle valve 14. As a result, the engine 10 is smoothly rotated to ensure comfortable travel feeling of the vehicle.

Figure 6:
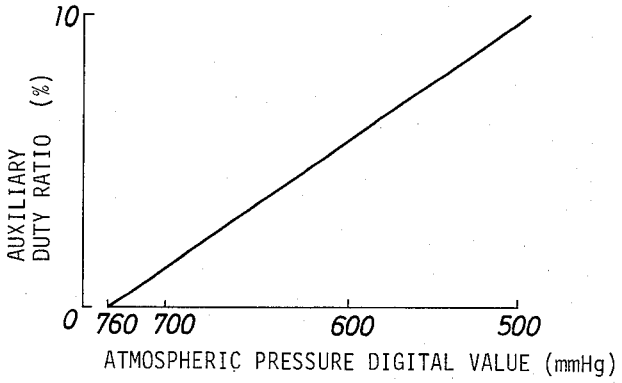
FIG. 6 depicts a graph indicating an auxiliary duty ratio related to an atmospheric pressure digital value.

When the vehicle is run at a stretch toward a high place from the low place without idle of engine 10, the atmospheric pressure lowers as the vehicle approaches the high place, and an auxiliary duty ratio calculated at step 186 is increased based on lowering of the atmospheric pressure in relation to the characteristic linear line of FIG. 6 to increase an added resultant duty ratio obtained at step 187. This means that a value of a second output signal appearing from microcomputer 100 at step 188 increases in accordance with increase of the added resultant duty ratio. Then, an opening degree of the flow control valve 131 is increased in dependence upon increase of the added resultant duty ratio under control of drive circuit 120 responsive to the second output signal from microcomputer 100 to increase an amount of air flow through the flow control valve 130 sucked into engine 10. Thereafter, the microcomputer 100 calculates at routine 170 a fundamental injection time based on the actual rotational speed and digital amount of air flow to compensate the same injection time as an optimum injection time, as previously described. Thus, the fuel injectors 16—16 inject fuel from the source of fuel into engine 10 during the optimum injection time, as previously described.

In other words, even if density of air decreases due to lowering of the atmospheric pressure as the vehicle runs from the low place to the high place, as previously described, an opening degree of flow control valve 131 increases in dependence upon decrease of density of air (or increase of the added resultant duty ratio) such that an air-fuel ratio is properly determined based on the amount of fuel injected into engine 10 and the amount of air flow defined by the actual opening degree of throttle valve 14 and the increasing added resultant duty ratio. This means that the engine 10 is smoothly rotated without shortage of an amount of air flow to ensure comfortable feeling during travel of the vehicle from the low place to the high place. In this instance, even if the engine 10 is conditioned in idling operation after arrival of the vehicle to the high place, smooth change in the actual rotational speed of engine 10 can be also ensured under control of the electronic fuel injection control system, because an amount of air flow into the engine 10 is properly maintained without influence of lowering of the actual atmospheric pressure, as previously described.

When the vehicle is run at a stretch from the high place to the low place during this stage, density of air increases in dependence upon rise of the atmospheric pressure, and an amount of air flow into the engine 10 is properly controlled in the substantially same manner as that in the above-mentioned operation. This means that an air-fuel ratio is always determined correctly to ensure smooth rotation of engine 10.

Although in the above embodiment the present invention is adapted to the four cylinder internal combustion engine 10, it may be also adapted to internal combustion engines of various types.

For practise of the present invention, the pressure sensor 90 may be replaced with, for example, a pressure switch of the normally open type which is arranged to be closed when the atmospheric pressure lowers down to a predetermined atmospheric pressure lower than 760 mmHg. In this case, the microcomputer 100 may be arranged to set at step 186 the auxiliary duty ratio to zero based on opening of the pressure switch and also to set the auxiliary duty ratio to a predetermined value indicative of an additional amount of air flow into engine 10 upon closure of the pressure switch.

Having now fully set forth both structure and operation of a preferred embodiment of the concept underlying the present invention, various other embodiments as well as certain variations and modifications of the embodiment herein shown and described will obviously occur to those skilled in the art upon becoming familiar with said underlying concept. It is to be understood, therefore, that within the scope of the appended claims, the invention may be practiced otherwise than as specifically set forth herein.

What is claimed is:

1. An air flow control apparatus for controlling an amount of air flow under control of a throttle valve in an internal combustion engine, the control apparatus comprising:

first means for producing a first signal indicative of operating condition of said engine;

second means for detecting change of the atmospheric pressure and for producing a second signal indicative of the actual atmospheric pressure;

third means for determining whether or not a value of said first signal indicates an idling condition of said engine if so, producing a first determination signal and if not, producing a second determination signal;

fourth means responsive to said first determination signal for determining, in dependence upon the value of said first signal, a first parameter indicative of an amount of air flow into said engine necessary for maintaining the operation of said engine in a desired idling condition;

fifth means responsive to said second determination signal for determining, in dependence upon the value of said first signal, a second parameter indicative of an amount of air flow into said engine based on a first predetermined relationship between the second parameter and loaded condition of said engine;

sixth means for determining, in dependence upon a value of said second signal, a third parameter indicative of an additional amount of air flow into said engine based on a second predetermined relationship between the third parameter and the atmospheric pressure;

seventh means for compensating the second parameter in accordance with the third parameter;

eighth means for producing a first output signal indicative of the first parameter and for producing a second output signal indicative of the compensated second parameter; and ninth means responsive to said first and second output signals for controlling an amount of air flow respectively in accordance with idling and loaded conditions of said engine.

2. An air flow control apparatus as claimed in claim 1, wherein said first means is arranged to produce a first signal indicative of a temperature of said engine; and wherein the first predetermined relationship is a predetermined relationship between the second parameter and the temperature of said engine, and the second predetermined relationship is a proportional relationship between the third parameter and the atmospheric pressure.

3. An air flow control apparatus as claimed in claim 2, wherein said second parameter is a main duty ratio indicative of an amount of air flow into said engine, and the third parameter is an auxiliary duty ratio indicative of an additional amount of air flow into said engine; and wherein said seventh means is arranged to add the main duty ratio to the auxiliary duty ratio such that said second output signal indicates the added ratio.

4. An air flow control appartus as claimed in claim 1, further comprising a bypass passage connected to an induction passage of said engine to bypass said throttle valve;

wherein said ninth means is an electrically operated valve which is disposed within said bypass passage and responsive to said first and second output signals to control an amount of air flow through said bypass passage respectively in accordance with idling and loaded conditions of said engine.

5. An air flow control apparatus for controlling an amount of air flow under control of a throttle valve in an internal combustion engine, the control apparatus comprising:

means for producing a first signal indicative of operating condition of said engine;

a pressure switch for producing a pressure signal upon its actuation when the atmospheric pressure decreases below a predetermined pressure lower than a standard atmospheric pressure;

means for determining whether or not a value of said first signal indicates an idling condition of said engine if so, producing a first determination signal and if not, producing a second determination signal;

means responsive to said first determination signal for determining, in dependence upon the value of said first signal, a first parameter indicative of an amount of air flow into said engine necessary for maintaining the operation of said engine in a desired idling condition;

means responsive to said second determination signal for determining, in dependence upon the value of said first signal, a second parameter indicative of an amount of air flow into said engine based on a predetermined relationship between the second parameter and loaded condition of said engine;

means responsive to said pressure signal for adding the second parameter to a predetermined value indicative of an additional amount of air flow into said engine required based on decrease of the atmospheric pressure;

means for producing a first output signal indicative of the first parameter and for producing a second output signal indicative of the added value; and means responsive to said first and second output signals for controlling an amount of air flow respectively in accordance with idling and loaded conditions of said engine.

* * * * *